US009713353B2

(12) United States Patent
Roman

(10) Patent No.: US 9,713,353 B2
(45) Date of Patent: Jul. 25, 2017

(54) LEG HANDLE COMPRISING THIN STRETCH FABRIC AND ROUNDED CYLINDRICAL SECTION

(71) Applicant: Kendyl A. Roman, Sunnyvale, CA (US)

(72) Inventor: Kendyl A. Roman, Sunnyvale, CA (US)

( * ) Notice: Subject to any disclaimer, the term of this patent is extended or adjusted under 35 U.S.C. 154(b) by 0 days.

(21) Appl. No.: 14/829,554

(22) Filed: Aug. 18, 2015

(65) Prior Publication Data

US 2015/0351473 A1 Dec. 10, 2015

Related U.S. Application Data

(63) Continuation of application No. 13/356,647, filed on Jan. 24, 2012, now abandoned, which is a continuation-in-part of application No. 12/151,303, filed on May 5, 2008, now abandoned.

(51) Int. Cl.
*A41D 1/08* (2006.01)
*A41D 27/00* (2006.01)
*A63B 71/12* (2006.01)

(52) U.S. Cl.
CPC ..... *A41D 27/00* (2013.01); *A41D 1/08* (2013.01); *A63B 71/1225* (2013.01); *A63B 2071/1241* (2013.01); *A63B 2243/0066* (2013.01)

(58) Field of Classification Search
CPC ..... A41D 1/08; A41D 27/00; A63B 69/00; A63B 71/1225; A63B 2243/0066
USPC .... 2/22–24, 59, 60, 162, 170; 128/878–880; 602/20–23
See application file for complete search history.

(56) References Cited

U.S. PATENT DOCUMENTS 8,523,713 B2 * 9/2013 Roman ..... A41D 1/08 473/438
8,556,754 B2 * 10/2013 Roman ..... A63B 5/00 473/438
2008/0032824 A1 * 2/2008 Roman ..... A41D 1/08 473/415

* cited by examiner

*Primary Examiner* — Katherine Moran

(57) ABSTRACT

A leg handle with preferably hollow cylindrical sections is used to aid in lifting a jumping player, especially for lineouts in World Rugby. The handles are preferably made of one or more foam sausages attached to a thin stretch fabric sleeve which is placed the leg of the jumper and when jumping allow for secure grasp by lifters. To use, leg handles are applied to one or more legs of a jumper and held in place with tape. When the jumper jumps, one or more lifters place their hands against the leg handle. The lifters lift the jumper higher, support the jumper in the jump while the jumper attempts to intercept a ball, and safely lower the jumper. Leg handles comprising cylindrical sections are embodied with a single sausage; a lower front sausage and a higher back sausage; or as a pair of such sausages integrated into respective legs of a pair of compression shorts. To comply with the World Rugby law regarding clothing thickness, a wall thickness of four millimeter is preferred resulting in a combined thickness of five millimeters.

20 Claims, 7 Drawing Sheets

PRIOR ART

LEG HANDLE COMPRISING THIN STRETCH FABRIC AND ROUNDED CYLINDRICAL SECTION

RELATED APPLICATIONS

The contents of U.S. patent application Ser. Nos. 12/151,303 and 13/356,647 are included herein by reference.

BACKGROUND

Field of the Invention

This invention relates to a leg handle used when lifting a person who is jumping or being lifted, for example a jumper in a Rugby lineout. In particular, a leg handle comprising a cylindrical section.

Description of Prior Art

There is a need to jump high in order to intercept a ball in many sports, such as Rugby, volleyball, or baseball.

For example, in Rugby Union, when a ball goes out of bounds it is returned to play using a set formation known as a lineout. In a lineout, players from both teams line up near where the ball went out of bounds. Each team forms its own line. A space of about one yard is formed between the lines of players, referred to as the tunnel. The ball is then thrown back into the playing field. The ball must be thrown straight into the middle of the tunnel. Players compete for the ball. A player has a greater likelihood of winning the ball if he is higher in the air than others. Therefore, players jump and/or are lifted up by teammates to be in a favorable position to win possession of the ball.

Other activities such as ice skating and dancing also involve lifts.

Various methods have been employed to accomplish these types of lifts and jumps.

Originally, players jumped unassisted by teammates, but the laws (rules) of Rugby Union have changed to allow teammates to support a player while in the air. At first, lifters would grab the waist of the jumper's cotton Rugby shorts. It is currently illegal to grab on to or bind to the player while the player is on the ground. As time passed, it became common to support a jumping player by grabbing the player by the bottom of the shorts and lifting him/her by the shorts long enough to play the ball. More recently, it has been made legal to grab the jumping player by the thighs above the knee. Many jumping players wrap a combination of materials and tapes around the thigh to offer those lifting a better grip.

The use of such techniques has several disadvantages such as:

- Being ineffective, as a good grip is often still difficult to maintain
- Being unsafe, as jumping players that are dropped because of poor grip can fall up to 10 feet and land in an awkward position
- Damage to or tearing of clothing, especially if the proper shorts are not worn
- Extreme discomfort to the jumper, especially in the groin area
- Taking time to apply during the critical stages of pre-match preparation
- Requiring a large amount of tape, e.g. almost a full roll of athletic tape
- Requiring help to apply, as taping one's own leg is often difficult to do satisfactorily
- Needing to be taped before every game or practice It is also desirable to have a means for lifting that does not cause additional bunching and riding up of the short Rugby shorts and that looks better.

Regulation Rugby shorts are made of thick, non-stretch cotton fabric. The shorts are used to bind onto other players during play such as scrums, rucks, and mauls. The shorts are also used to lift jumpers. The legs of the Rugby short are short and wide allowing the player a large range of leg movement and reducing the surface area that may be used to disadvantageously tackle the wearer. Thus, a primary characteristic of Rugby shorts is that they are non-stretch, short-legged, and loosely fitting.

The laws of World Rugby limit the thickness of player clothing and equipment, in particular no padded equipment may be thicker than 5 millimeters.

For extra support, modesty, and comfort, it is common for Rugby players to also wear skin-tight, longer-legged, compressions shorts made of low denier stretch fabric, known as Spandex or Elastane. These separate and distinct compression shorts are worn under their regulation Rugby shorts.

On Feb. 26, 1999, Halbro Sportswear applied for a UK patent, application GB 2347067A, where strips of non-stick material are sewn into the sides and lower edges of regulation Rugby shorts. These strips of non-stick material allow teammates to more easily grip the Rugby shorts during a Rugby lineout.

Later, elastic neoprene sleeves comprising a non-slip gripping surface have been placed around legs. On Apr. 22, 2003, Mark Giarcheri filed application PCT/GB03/01719 showing a neoprene sleeve comprising a non-slip gripping surface with a ridge at the top. In 2005, KooGa introduced a "Lineout Support" comprising a neoprene sleeve with a non-slip gripping surface.

Elastic sleeves comprising other types of means for gripping have been placed around legs. For example, U.S. patent application Ser. No. 11/499,023, filed Aug. 3, 2006, and U.S. patent application Ser. No. 11/800,356, filed May 4, 2007, disclose my earlier attempts to solve these problems. While successful in part, those earlier attempts still suffer from various problems.

More recently, the Centurion brand (Primo Play Ltd.) introduced Aerial Supports™ consisting of a heavy neoprene housing a rubber lifting block. Deacon Manu developed Aerial Supports™.

Elastic leg sleeves have several disadvantages such as:

- Being constricting during the activity between lifts
- Being too elastic and sliding up during lifts
- Being hot, causing excessive sweating and odor
- Having material break down
- Being relatively heavy
- Having relative expensive materials
- Having materials requiring expensive equipment to manufacture
- Being complex, and thus costly to manufacture
- Sliding down the leg There is a need for a means to improve lifting in all levels of play, as ineffective lifts can be costly, dangerous, and contribute significantly to losing a game.

What is needed is an improved lightweight, low cost, easy to manufacture, quick, simple, easy to use, reusable, Rugby law compliant device that provides an effective means of obtaining a sure grip that offers comfort and safety to the players involved.

Further, what is needed is a device that can be used by new players and youth to safely develop their technique, skill, and timing during practices and prior to game situations that may require conventional lifting aids.

SUMMARY OF THE INVENTION

Accordingly, it is an objective of the present invention to provide an improved lightweight, low cost, easy to manufacture, quick, easy to use, simple, reusable, effective, Rugby law compliant means of lifting a jumper that provides safety, comfort, and high performance for those involved.

Objects and Advantages

Accordingly, beside the objects and advantages described above, some additional objects and advantages of the present invention are:

1. To provide a comfortable method of lifting a player who is jumping.
2. To provide a more effective method of obtaining a sure grip on the thighs of a jumping player.
3. To provide an increase of safety for a jumping player being lifted by the thighs.
4. To provide means and methods of lifting that are easy to use.
5. To provide means and methods of lifting that are reusable.
6. To provide means and methods of lifting that offer higher performance.
7. To provide means and methods of lifting that can be quickly applied and removed.
8. To provide means and methods of lifting that are adjustable to varying conditions.
9. To empower a less skilled lifter to lift a jumper by himself.
10. To provide means and methods of lifting that are minimal in cost and waste.
11. To provide means and methods of lifting that do not worsen a user's appearance.
12. To provide means and methods of lifting that improve a user's appearance.
13. To provide means of lifting that do not stretch and slide up the jumper's leg during the lift.
14. To provide a youth and new player development device that can be safely used to teach technique, skill, and timing.
15. To reduce the waste of materials such as tape.

DRAWING FIGURES

In the drawings, closely related figures have the same number but different alphabetic suffixes.

REFERENCE NUMERALS IN DRAWINGS

| | |
|---|---|
| 110 | first jumper |
| 112 | shorts |
| 120 | first lifter |
| 121 | left hand of first lifter |
| 122 | right hand of first lifter |
| 130 | second lifter |
| 131 | left hand of second lifter |
| 132 | right hand of second lifter |
| 140 | ball |
| 150 | second jumper |
| 154 | thigh |
| 160 | third lifter |
| 161 | left hand of third lifter |
| 162 | right hand of third lifter |
| 170 | fourth lifter |
| 171 | right hand of fourth lifter |
| 172 | left hand of forth lifter |
| 180 | third jumper |
| 190 | tape underwrap |
| 192 (a-c) | tape |
| 194 | bulge |
| 201 | foam sausage |
| 202 (a-b) | cylindrical section |
| 203 (a-c) | smaller cylindrical section |
| 204 | hollow cylinder |
| 205 | double sausage |
| 206 | sausage compression shorts |
| 208 | back sausage |
| 209 | front sausage |
| 232 (a-c) | thin stretch fabric |
| 301 | high friction grippable member |
| 302 | non-slip surface |
| 303 | first half-sphere protruding point |
| 304 | second half-sphere protruding point |
| 305 | rectangular ridge member |
| 810 | base strap |
| 871 | single sausage pattern |
| 872 | double sausage pattern |
| 876 | compression short pattern |
| 877 | sausage cover |
| 878 | back sausage position |
| 879 | front sausage position |
| 990 | lower thigh |
| 992 | knee |
| 994 | calf |

DESCRIPTION OF THE INVENTION

The present invention comprises a leg handle comprising a hollow cylindrical section. When a person jumps, one or more other people can assist the jumper by gripping leg handle. Such a lifter is able to lift the jumper higher, support the jumper while in the air, and safely lower the jumper to the ground. When the jumper is not jumping, the jumper is able to run or otherwise move without hindrance or discomfort.

FIG. 1A

Figure 1A:
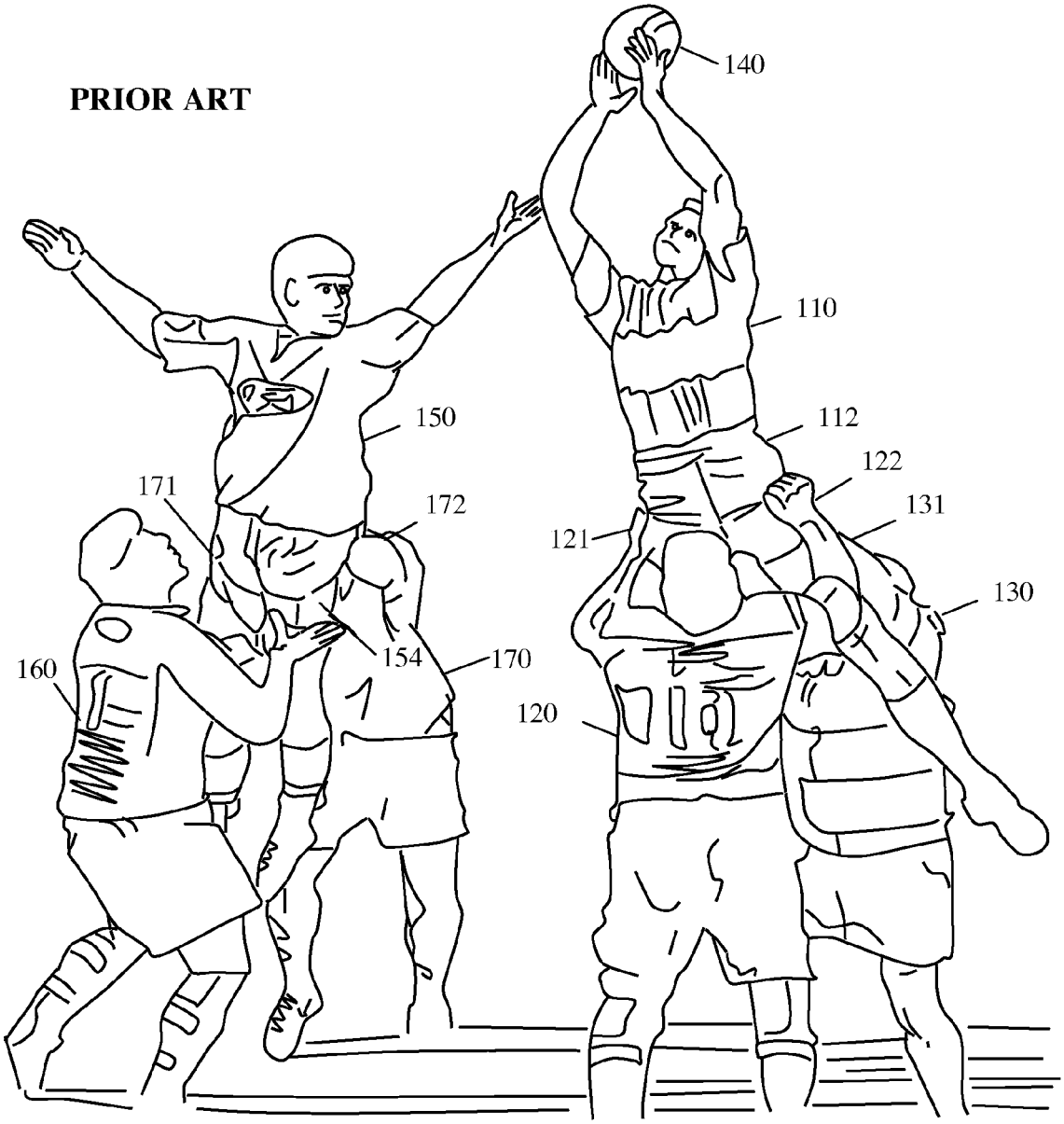
FIG. 1A through FIG. 1C show prior art techniques and devices for lifting a jumper.

FIG. 1A illustrates two conventional means of lifting. As shown on the right, a first jumper 110 is lifted by a first lifter 120 and a second lifter 130. As shown on the left, a second jumper 150 is lifted by a third lifter 160 and a fourth lifter 170.

A first conventional means for lifting (gripping the shorts) is shown on right. The first jumper 110 is lifted by his shorts 112. The first lifter 120 lifts using both his left hand 121 and his right hand 122 on the bottom front of the shorts 112. The second lifter 130 is gripping the shorts with his left hand 131 and his right hand 132 (not shown) to lift. These grips allow the first lifter 120 and second lifter 130 to lift first jumper 110 to a height where he can intercept the ball 140.

A second conventional means for lift (gripping the thigh) is shown on the left. The fourth lifter 170 is using a similar technique of lifting as the second lifter 130 and uses both his right hand 171 and his left hand 172. Third lifter 160 is lifting second jumper 150 by his thigh 154. Note that the second jumper 150 is unstable, is falling, and was unable to intercept the ball because of the bad lift.

Lifting by the shorts has many disadvantages including, for example, discomfort for the jumper, less than optimal lift performance, and difficult to obtain grip. It is also difficult to obtain a secure grip on a bare thigh (e.g. third lifter 160), especial when the skin is covered with sweat.

FIG. 1B

Figure 1B:
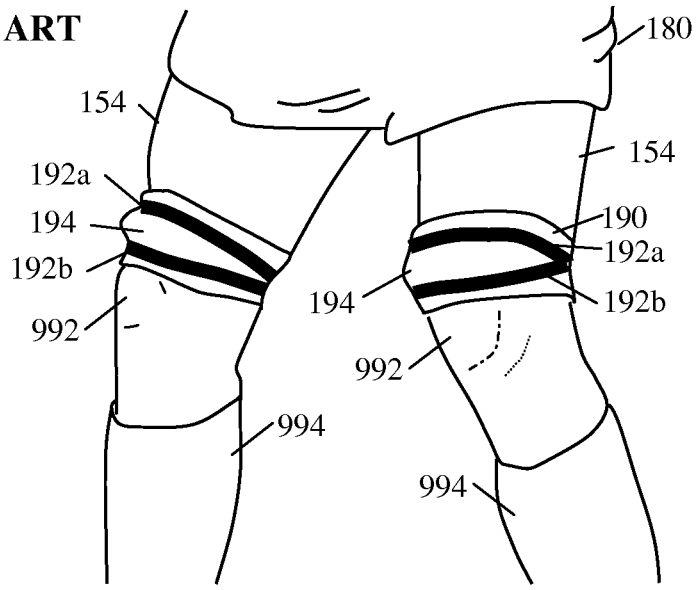
Fig. 1B PRIOR ART

FIG. 1B illustrates a third jumper 180 with material wrapped around his thighs 154, just above each knee 992. The one-time-use material consists of an underwrap 190 covered by an upper strip of tape 192*a* and a lower strip of tape 192*b*. The tape underwrap 190 may consist of fabric athletic tape, stretch tape, or foam underwrap tape. Typically the tape 192 is black, plastic, electrical tape. This arrangement creates a bulge 194. The bulge 194 may include additional layers of the foam tape underwrap 190 or cloth material.

The one-time-use thigh wrap also has many disadvantages including, for example, difficulty in applying consistently, requiring application by coach, trainer, or other player during the critical pre-game preparation time, discomfort, waste of materials, and debris often left behind.

FIG. 1C

Figure 1C:
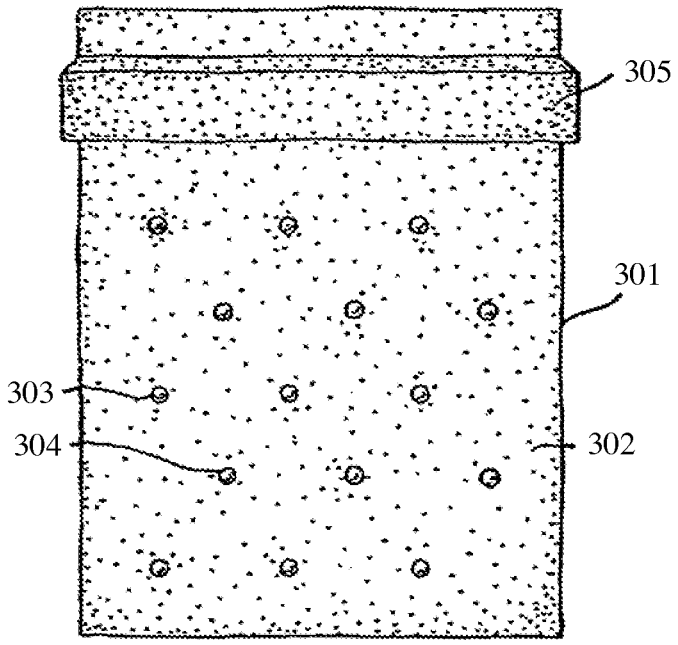

FIG. 1C illustrates a neoprene sleeve comprising a non-slip gripping surface with a ridge at the top. The high friction grippable member 301 comprises a non-slip surface 302, with a first half-sphere protruding point 303 and a second half-sphere protruding point 304, and rectangular ridge member 305.

FIG. 2

Figure 2:
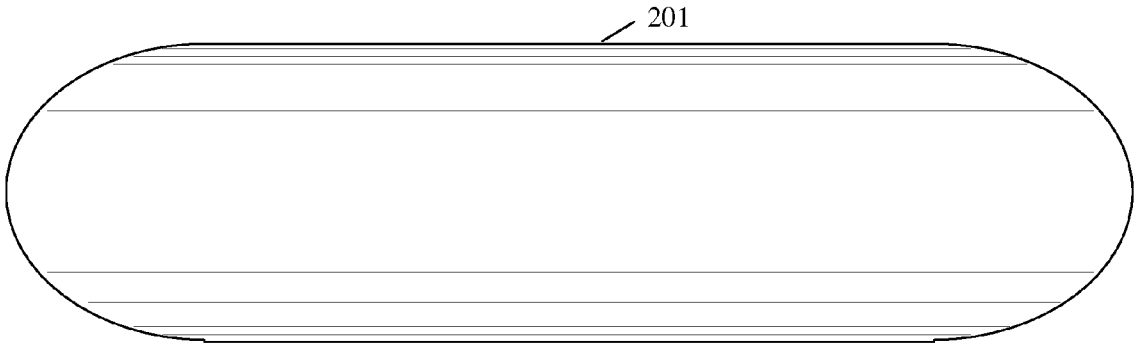
FIG. 2 illustrates an embodiment of a foam sausage.

FIG. 2 illustrates an embodiment of a foam sausage 201. The sausage 201 is shown with rounded ends. The sausage has the shape of cylindrical section.

FIG. 3

Figure 3:
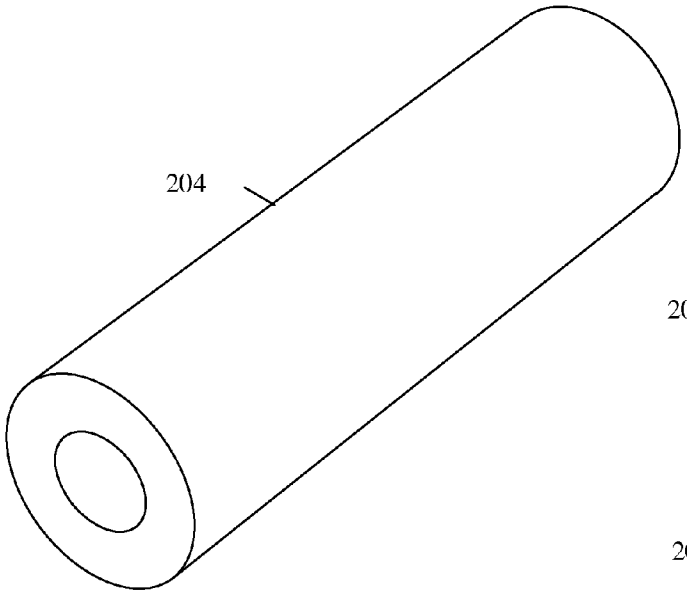
FIG. 3 illustrates a hollow cylinder.

FIG. 3 illustrates a hollow cylinder 204. In a preferred embodiment, the hollow cylinder is made of soft foam with a wall thickness of between approximately four (4) and approximately twenty-nine (29) millimeters in radius. Good results have been found with a wall thickness of three-eights of an inch.

Figure 4A:
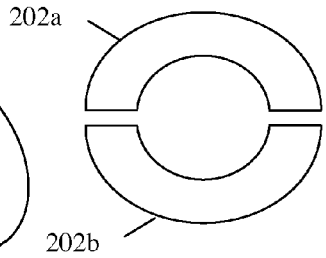
FIG. 4A and FIG. 4B show cross sections of cylindrical sections.
Figure 4B:
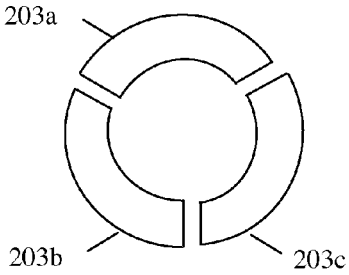

FIG. 4A and FIG. 4B

FIG. 4A and FIG. 4B show cross sections of cylindrical sections. The cylindrical section of the present invention may be molded to shape or cut from a pre-manufactured foam cylinder such as one shown in FIG. 3. A hollow cylinder can be cut in half resulting in two half cylindrical sections, 202*a* and 202*b*, respective, as shown in FIG. 4A. Alternatively, it may be cut into three or more smaller cylindrical sections, as illustrated by smaller cylindrical sections 203 (*a-b*) in FIG. 4B.

FIG. 5

Figure 5:
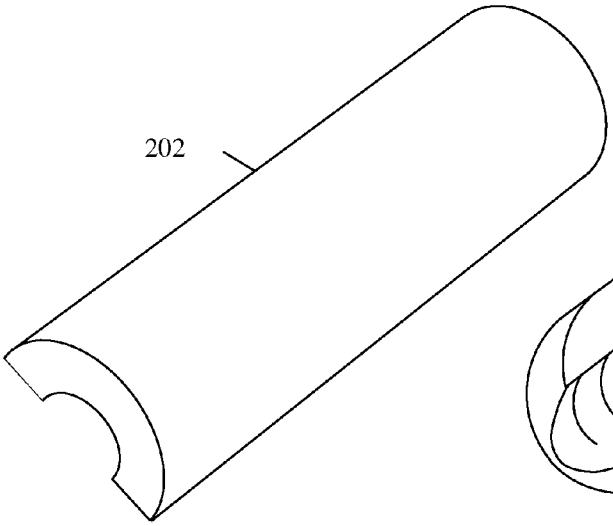
FIG. 5 shows a cylindrical section.

FIG. 5 shows a cylindrical section 202 made, for example, by cutting a hollow cylinder 204 (FIG. 3) in half as shown in the cross section of FIG. 4A.

FIG. 6

Figure 6:
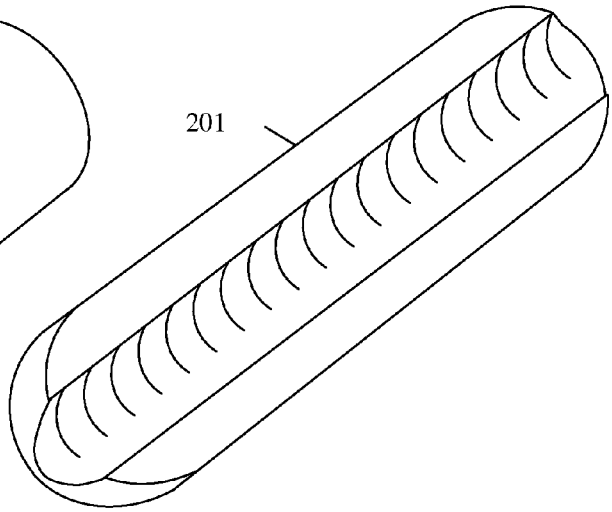
FIG. 6 shows a back view of a cylindrical section with rounded ends, forming a sausage.

FIG. 6 shows a foam sausage 201 formed by rounding the ends of the cylindrical section shown in FIG. 5. A currently preferred embodiment of a foam sausage 201 conforms to my design patent application 29/293,086, filed Dec. 11, 2007, now U.S. Design Pat. D617,054, and has a length of approximately five inches, and a radius of approximately three-quarters of an inch resulting in a convex surface distance of over two inches. To comply with the World Rugby law regarding thickness a wall thickness of approximately four (4) millimeter is preferred. Other embodiments may have a larger radius and convex face, for example, a radius of approximately one and one-quarter inches.

FIG. 7A

Figure 7A:
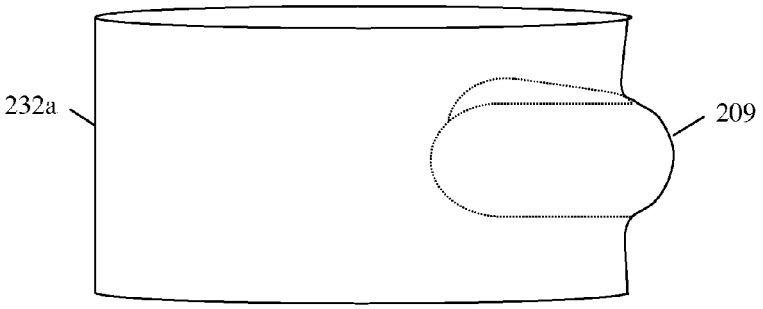
FIG. 7A illustrates a thin stretch fabric sleeve with a front sausage.

FIG. 7A illustrates a thin stretch fabric 232*a* sleeve with a front sausage 209. In a currently preferred embodiment, the thin stretch fabric is low denier fabric with about ten to fifteen percent spandex (elastane) and a remainder of nylon, and having a thickness of substantially approximately one-half of a millimeter. The front sausage 209 is preferably a foam sausage 201 (FIG. 2). As discussed above in relation to FIG. 6, to comply with the World Rugby law regarding padding thickness a wall thickness of approximately four (4) millimeter for the foam sausage 201 is preferred, so that when two layers of thin stretch fabric, each with a thickness of approximately one-half a millimeter, enclose the sausage 201, the total thickness of five (5) millimeters or less is compliant with the laws of World Rugby.

Spandex stretch fabric is well known to be a woven fabric comprised of synthetic fibers known for their exceptional elasticity. Spandex fibers comprise polyurethane-polyurea copolymer strands. The elastic copolymer strands are typically combined with strands of another material, such as nylon. What gives spandex its special properties is that it has hard and soft blocks in its repeat structure.

FIG. 7B

Figure 7B:
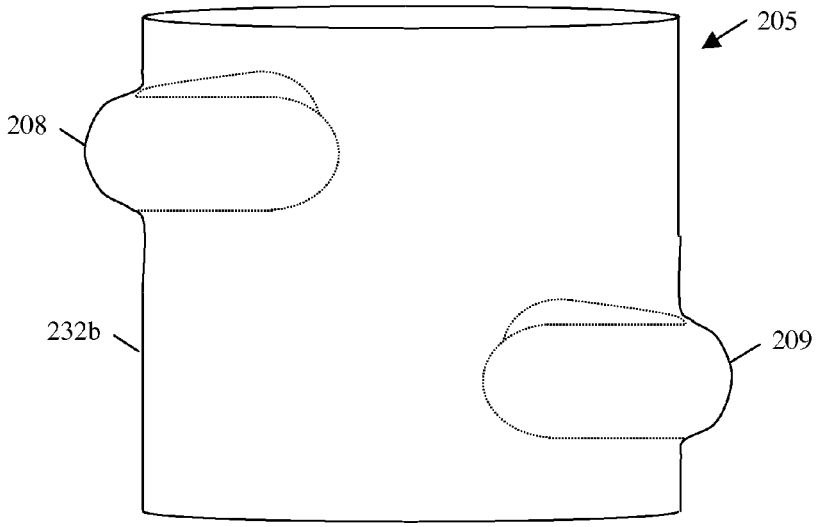
FIG. 7B illustrates a thin stretch fabric sleeve with a front and back sausages.

FIG. 7B illustrates a thin stretch fabric 232*b* sleeve with a front sausage 208 and a back sausage 209. The sausages (208 and 209, respectively) are preferably each a foam sausage 201 (FIG. 2).

FIG. 7C

Figure 7C:
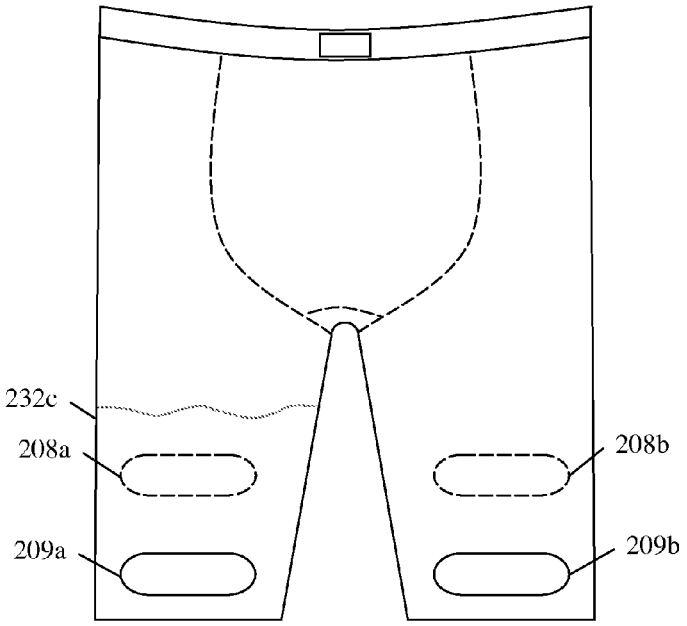
FIG. 7C illustrates compression shorts with a front and back sausage in each leg.

FIG. 7C illustrates compression shorts comprised of thin stretch fabric 232*c* with a front sausage 209 and a back sausage 208 in each leg (e.g. 208*a* and 209*a* in the right leg and 208*b* and 209*b* in the left leg, as worn by a jumper).

Figure 8A:
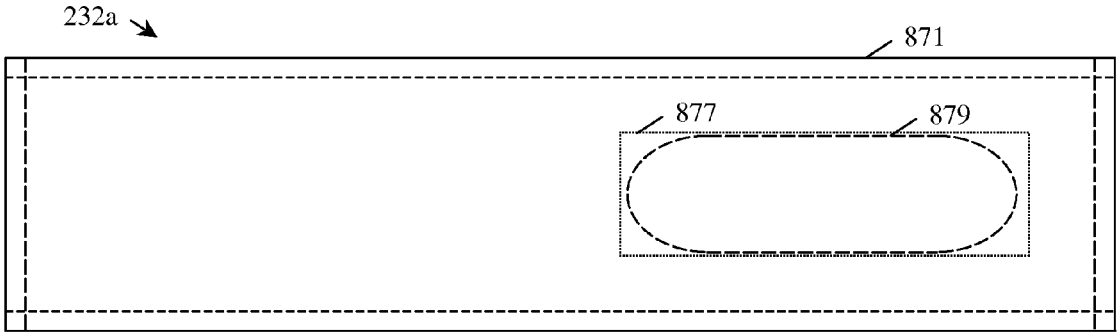
FIGS. 8A through 8C illustrate a single sausage pattern, a double sausage pattern, and a compression short pattern.
Figure 8B:
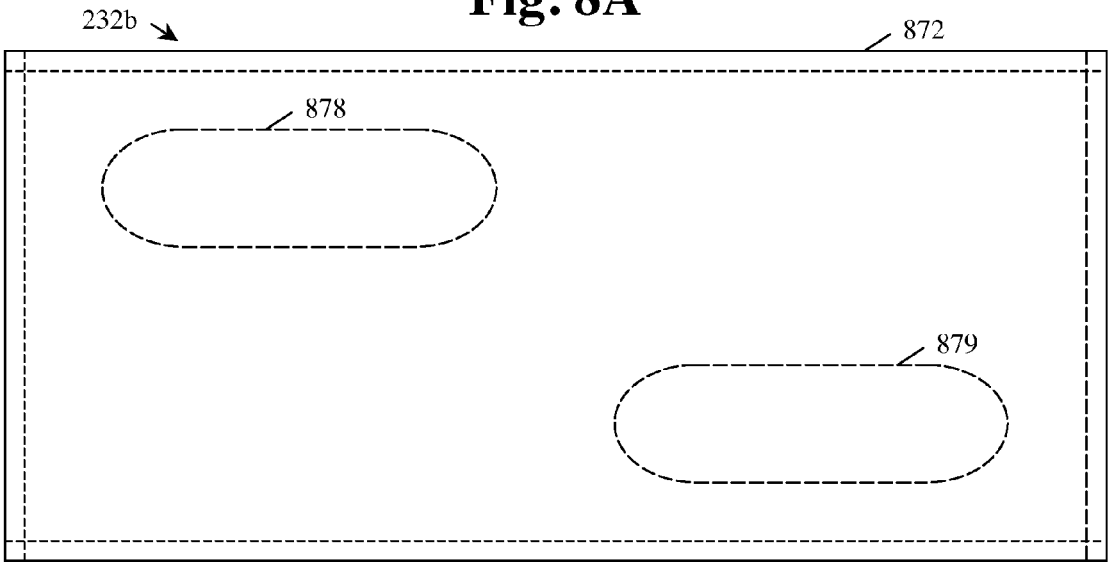
Figure 8C:
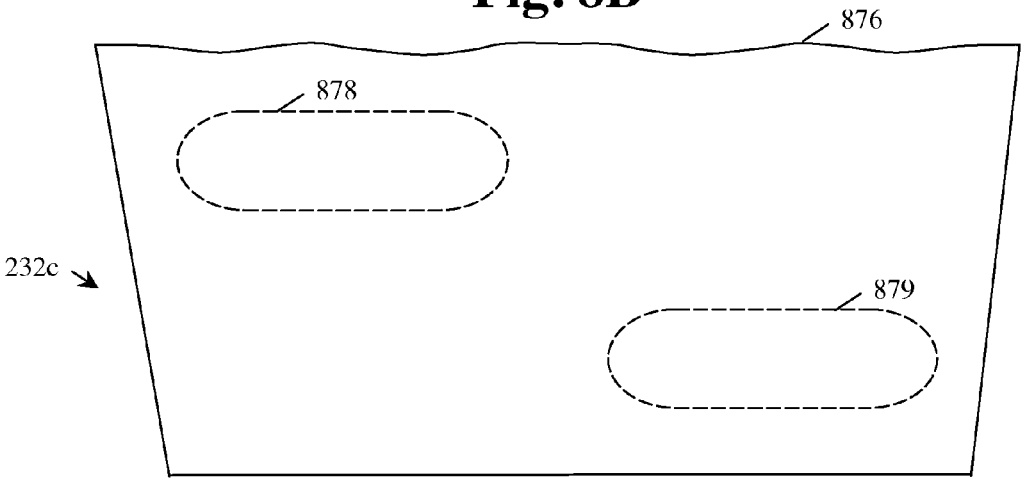

FIG. 8A Through FIG. 8C

FIGS. 8A through 8C illustrate a single sausage pattern 871, a double sausage pattern 872, and a compression short pattern 876.

FIG. 8A shows a single sausage pattern 871 for the thin stretch fabric 232*a*. The front sausage position 879 is represented by a dashed line. In one method of construction, a pocket is formed by sewing a sausage cover 877 to the inside of the thin stretch fabric 232*a*, a sausage 201 is inserted into the pocket and the pocket is sewn closed. Flexible adhesive may also be used.

FIG. 8B shows a double sausage pattern 872, thin stretch fabric 232*b*. In addition to the front sausage position 879, the back sausage position 878 is shown.

FIG. 8C a partial, compression short pattern 876, thin stretch fabric 232*c*. Only one leg is shown with each respective front sausage position 879 and back sausage position 878.

To comply with the World Rugby law regarding clothing thickness, the combined thickness of the stretch fabric (232*a*, 232*b*, or 232*c*, respectively), the wall of the hollow cylindrical section of the sausage 201, and the cover 877 is five (5) millimeters or less. Others have attempted to make Rugby lifting aids but have been unsuccessful in providing a large enough grip that also complies with the World Rugby law regarding thickness. My novel hollow cylindrical section provides for a larger effective grip, while complying with the World Rugby law regarding thickness. When flattened for measurement, it is five (5) millimeters or less, but when gripped by a lifter it provides a sufficient size and shape where the radius of the outside of cylinder is substantially greater than five (5) millimeters.

FIG. 8D

Figure 8D:
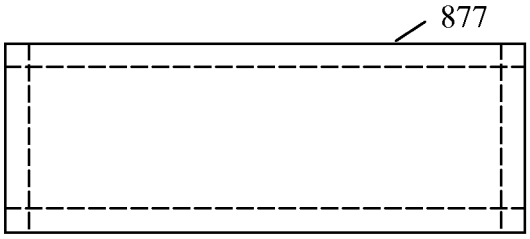
FIG. 8D illustrates a pattern for a sausage cover.

FIG. 8D a pattern for a sausage cover 877 which may comprise the same thin stretch fabric. The edges of the pocket may be folded over prior to sewing resulting in a smooth edge.

FIG. 9

Figure 9:
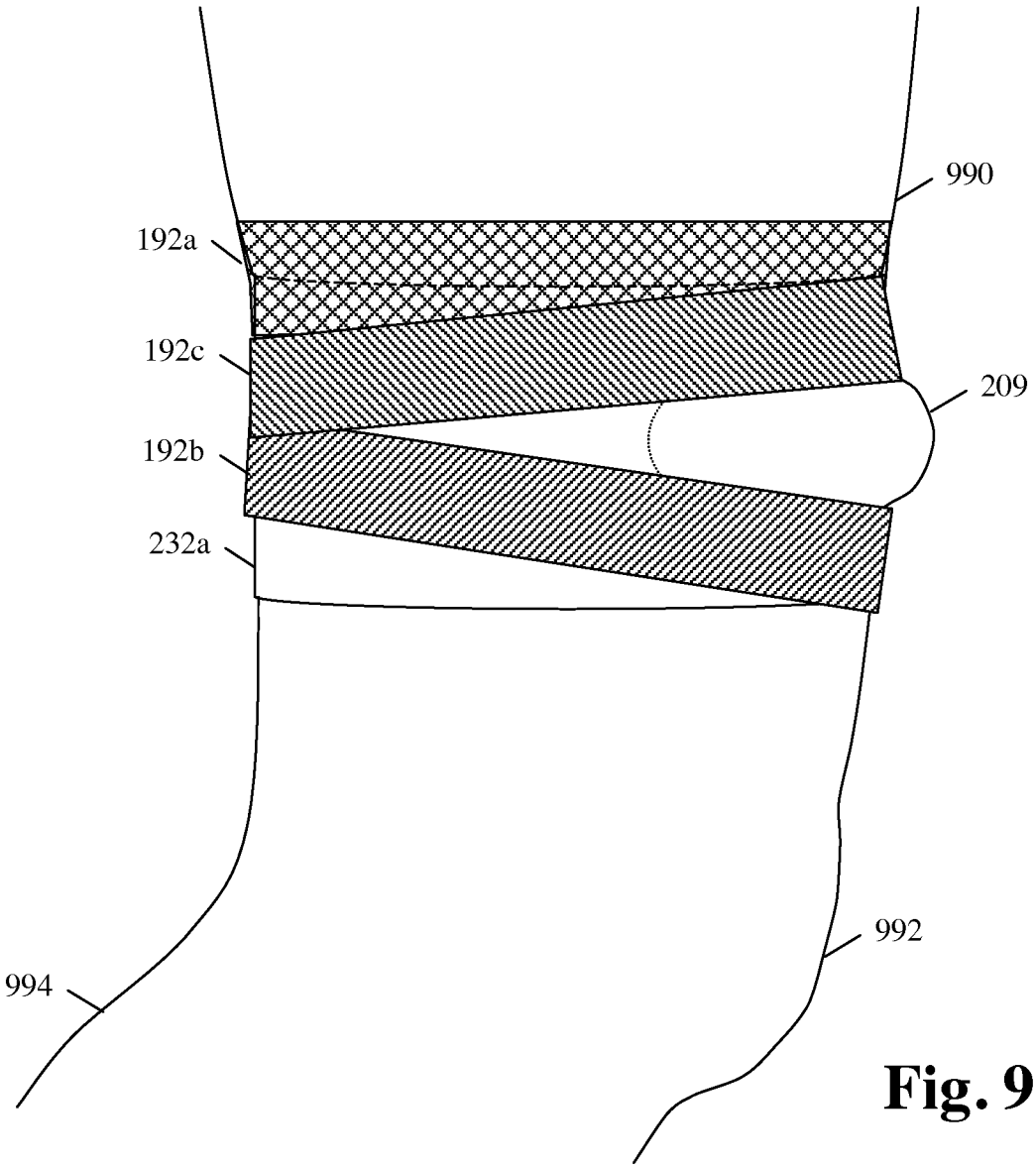
FIG. 9 illustrates using tape over the thin stretch fabric on a thigh.

FIG. 9 illustrates using tape over the thin stretch fabric 232*a* of a single sausage (FIG. 7A) on a lower thigh 990. To apply the device is placed over the leg and position above the knee 992. To prevent the device from slipping down the leg, while running around, at least one wrapping of tape 192*a* is used to tape the thin stretch fabric 232*a* to the skin of the lower thigh 990. To prevent the device from slipping up the leg during the lift, one or more wrappings of tape 192*b* (and optionally 192*c*) are taped over the thin stretch fabric 232*a* below (and optionally above) the front sausage 209. The tape, 192*b* and 192*b*, may be fabric athletic tape or may be plastic electrical tape.

Although not shown a similar arrangement of tape may be applied over each sausage (208, 209, 208*a*, 209*a*, 208*b*, and 209*b*, respectively).

In yet another embodiment of a method for use, a wrapping of stretch tape with a tacky surface is applied over the respective sausage (e.g. 209) prior to applying tape 192*b* and 192*c*.

Other Uses

While the descriptions of the various embodiments have been made in reference to Rugby Union, the present invention could also be used for other sports which involve, or in the future may involve, lifting, such as Volleyball, International Rules Football, Australian Rules Football, baseball, ice skating, dance, or other sports.

Advantages

Comfortable

The leg handles of the present invention offer comfort to the jumping player. The leg handles do not apply pressure to the sensitive crotch areas of the body, as conventional methods of lifting do. The leg handles also reduce pulling out the hairs of the leg during removal, as in certain conventional methods.

Effective

The leg handles of the present invention are effective. A lifter has much better odds for obtaining and maintaining a sure grip with the present invention than with conventional methods. Thus, the jumper is more consistently able to obtain an optimum jump.

Safe

Because of the effectiveness of the the present invention in allowing lifters to have a sure grip, the present invention offers greater safety and lessens risk of injury to both jumping and lifting players, and even opponents Simple The present invention is simple to make and use. The present invention requires less time to put on.

Easy to Use

The present invention is easy to use. To install, the potential jumper simply applies over one or more legs. The lifters easily can find a grip while lifting the jumper.

Unlike conventional methods of lifting, which require a second party such as a trainer or coach to apply and runs the risk of inconsistency, the present invention is easily put on and taped by one person (including the wearer) and gives consistent results.

Reusable-Reduced Waste

The present invention can be used over and over again. The conventional method of using entirely tape, most of the material can only be used once and a new material must be used for every application. With these devices and methods, most of the material is reused and much less tape is required.

Because the conventional foam wraps and tapes can only be used once, the materials become trash after use. The remains of the foam wraps and tape are often strewn on the field and leave an unsightly, unprofessional appearance requiring extra effort to clean up.

Higher Performance

The present invention offers higher performance in jumping than conventional methods. The quality of grip maintained allows stronger and higher lift, for example during a Rugby lineout. Use of the present invention gives teams more options on plays to be run during the lineout. The use of the present invention does not hinder agility or running, as conventional taping sometimes does, because the taping is much less and can be applied looser.

Quick

The present invention can be quickly applied and removed. Time from warm-up and pre-game training need not be taken to apply the leg devices. The conventional method can take several minutes to apply and removal can also be a slow process. Conventional taping often requires assistance from a coach or other highly skilled person and detracts from the critical pre-game preparation.

Adjustable

One embodiment of the present invention can easily be adjusted for different players and thus are easily switched from player to player to accommodate substitutions.

Efficient

The conventional method of taping is wasteful. Trash is created after every game, and more tape and foam wrap materials need to be replaced and bought, adding to expenses. The present invention reduces the cost and trash significantly.

Better Appearance

Conventional methods of lifting worsen the look of players. The present invention has a smooth, professional look. While conventional taping has limited options, the present invention can easily be manufactured in a variety of colors to match the team color or the individual preference of the wearer. Space on the device material may also be used to bear a team logo, national insignia, or advertising.

Cost Effective

Because the leg handles can be made relatively inexpensively, are reusable, and reduce waste, the present invention is cost effective. In particular, the leg handle can be made very inexpensively, providing a larger market and encouraging less waste.

CONCLUSION, RAMIFICATION, AND SCOPE

Accordingly, the present invention provides an easy to use, simple, safe, comfortable, reusable, and effective means for lifting a jumper.

While the above descriptions contain several specifics these should not be construed as limitations on the scope of the invention, but rather as examples of some of the preferred embodiments thereof. Many other variations are possible. For example, different shapes and sizes of cylindrical sections of strap could be used. The cylindrical section could be made from a solid cylinder of foam, rubber, or similar material. Additionally, the leg devices could be made of different materials or have additional features, or be used in different sports, without departing from the scope and spirit of the novel features of the present invention.

Accordingly, the scope of the invention should be determined not by the illustrated embodiments, but by the appended claims and their legal equivalents.

I claim:

1. A leg handle to be worn on a leg of a jumper and engaged by one or more lifters, said leg handle comprising:

a) a first thin stretch fabric woven material, having a thickness approximately one half millimeter, said first thin stretch fabric woven material having been weaved with fibers comprising a polyurethane-polyurea copolymer, b) a second thin stretch fabric woven material, attached to the first thin stretch fabric woven material, forming a first pocket, and c) a cylindrical section, enclosed in the first pocket, wherein the first thin stretch fabric woven material is of sufficient size and shape to be worn around the lower thigh of the jumper, wherein the first thin stretch fabric woven material forms a leg sleeve, wherein, when not wrapped with tape, the first thin stretch fabric woven material slips freely up the leg, wherein the first thin stretch fabric woven material is configured to removably receive at least one wrapping of tape below the cylindrical section without the tape touching the skin of the leg of the jumper, whereby the leg handle is prevented from slipping up during the lift and whereby the skin and hair of the leg of the jumper is not adversely affected, wherein, when the jumper jumps to obtain a higher position, the jumper is lifted and held in the higher position by the one or more lifters, wherein the cylindrical section is formed from a hollow cylinder, wherein the cylindrical section is approximately five inches long, wherein the cylindrical section is between approximately three-quarters of an inch and approximately one and one-quarter inches in radius, wherein the wall thickness of cylindrical section is approximately four millimeters, wherein the cylindrical section has rounded sides and ends, wherein, when attached to the leg of a jumper, all of the sides and the ends of the cylindrical section taper smoothly down to the leg of the jumper, wherein the sides and ends which engage the hand of the lifter correspond to the shape of the hand of the lifter, wherein the cylindrical section is configured to securely engage a hand of one of the lifters while lifting, supporting, and lowering the jumper, whereby the jumper when wearing the leg handle:

i) is lifted and held in the higher position by at least one lifter, and ii) runs and jumps free of discomfort or interference from the leg handle.

2. A leg handle to be worn on a leg of a jumper and engaged by one or more lifters, said leg handle comprising:

a) a first thin stretch fabric woven material, having a thickness approximately one half millimeter, b) a second thin stretch fabric woven material, having a thickness approximately one half millimeter, attached to first thin stretch fabric woven material, forming a first pocket, and c) a cylindrical section formed from a hollow cylinder and enclosed in the first pocket, wherein the first thin stretch fabric woven material is of sufficient size and shape to be worn around the lower thigh of the jumper, wherein, when not wrapped with tape, the first thin stretch fabric woven material slips freely up the leg, wherein the first thin stretch fabric woven material is configured to removably receive at least one wrapping of tape below the cylindrical section without the tape touching the skin of the leg of the jumper, whereby the leg handle is prevented from slipping up during the lift and whereby the skin and hair of the leg of the jumper is not adversely affected, wherein, when the jumper jumps to obtain a higher position, the jumper is lifted and held in the higher position by the one or more lifters, wherein the cylindrical section is configured to securely engage a hand of one of the lifters while lifting, supporting, and lowering the jumper, whereby the jumper when wearing the leg handle:

i) is lifted and held in the higher position by at least one lifter, and ii) runs and jumps free of discomfort or interference from the leg handle.

3. The leg handle of claim 2, wherein the cylindrical section has rounded sides and ends, and wherein, when attached to the leg of a jumper, all of the sides and the ends of the cylindrical section taper smoothly down to the leg of the jumper, whereby the sides and ends which are engaged the hand of the lifter correspond to the shape of the hand of the lifter.

4. The leg handle of claim 2, wherein the cylindrical section is approximately five inches long.

5. The leg handle of claim 2, wherein the wall thickness of the cylindrical section is approximately four millimeters.

6. The leg handle of claim 2, wherein the cylindrical section is between approximately three-quarters of an inch and approximately one and one-quarter inches in radius.

7. The leg handle of claim 2, wherein the wall thickness of the cylindrical section is approximately three-eighths of an inch.

8. The leg handle of claim 2, wherein the wall thickness of the cylindrical section is between approximately four and approximately twenty-nine millimeters.

9. The leg handle of claim 2, further comprising:

d) a third thin stretch fabric woven material, attached to first thin stretch fabric woven material, forming a second pocket, and e) a second cylindrical section, enclosed in the second pocket, wherein first thin stretch fabric woven material forms compression shorts with two short legs, wherein the first pocket and the second pocket are positioned near the bottom of the two short legs, whereby the cylindrical sections are prevented from slipping down by the compression shorts compressing about the waist and legs of the jumper.

10. The leg handle of claim 2, wherein the first thin stretch fabric woven material forms a leg sleeve.

11. A system for supporting a jumper by one or more lifters, said system comprising two leg handles in accordance with claim 10, said two leg handles comprising a first leg handle to be worn on a one leg of the jumper and a second leg handle to be worn on the other leg of the jumper, wherein, prior to jumping, the first and second leg handles are applied to the corresponding legs of the jumper, and wherein, when jumping, a first hand of the at least one lifter grips the first leg handle and a second hand of the at least one lifter grips the second leg handle, whereby when the jumper jumps to higher position the at least one lifter is able to support the jumper with the first hand on the first leg handle and the second hand on the second leg handle.

12. A method for supporting a jumper by one or more lifters comprising the steps of:

a) applying at least two of the leg handles of claim 2 to the legs of the jumper, b) taping below each of the cylindrical sections, c) the jumper jumping into the higher position, d) the one or more lifters ascertaining the location of each cylindrical section, e) the one or more lifters engaging each leg handle, f) lifting the jumper to a second higher position, g) holding the jumper firmly in the second higher position until the jumper is able to intercept the ball, and h) lowering the jumper safely and securely, i) repeating steps b) through h) for a predetermined period of time, j) removing the leg handles, k) reapplying the leg handles, and l) repeating steps b) through h) for a second predetermined period of time.

13. The leg handle of claim 2, further comprising:

d) a third thin stretch fabric woven material, attached to first thin stretch fabric woven material, forming a second pocket, and e) a second cylindrical section, enclosed in the second pocket, wherein the first pocket is positioned on a lower front of the leg handle, wherein the second pocket is positioned on a upper back of the leg handle.

14. A unit of compression shorts with two integrated leg handles of claim 2, wherein the first thin stretch fabric woven material of the two integrated leg handles are connected and is of sufficient size and shape to be worn around the waist and thighs of the jumper, wherein at least one wrapping of tape is applied below each cylindrical section on the first thin stretch fabric of each integrated leg handle without touching the skin of the leg of the jumper, whereby each leg handle is prevented from slipping up during the lift and whereby the skin and hair of the leg of the jumper is not adversely affected.

15. The compression shorts with integrated leg handles of claim 14, wherein each cylindrical section has rounded sides and ends, and wherein, when attached to the leg of a jumper, all of the sides and ends of each cylindrical section taper smoothly down to the legs of the jumper, whereby the sides and ends which are engaged by the hands of the lifter correspond to the shape of the hands of the lifter.

16. The compression shorts with integrated leg handles of claim 14, wherein each cylindrical section is approximately five inches long.

17. The compression shorts with integrated leg handles of claim 14, wherein each cylindrical section is between approximately three-quarters of an inch and approximately one and one-quarter inches in radius.

18. The compression shorts with integrated leg handles of claim 14, wherein the wall thickness of each cylindrical section is approximately four millimeters.

19. The leg handle of claim 2, wherein the combined thickness of the first thin stretch fabric, the cylindrical section and the surrounding second thin stretch fabric material is less than or equal to five millimeters.

20. The leg handle of claim 2, wherein the combined thickness of the first thin stretch fabric, the cylindrical section and the surrounding second thin stretch fabric material complies with the laws of World Rugby.

* * * * *